US011773636B2

(12) United States Patent
Sprague

(10) Patent No.: US 11,773,636 B2
(45) Date of Patent: Oct. 3, 2023

(54) SLIDING PANEL SYSTEM AND METHOD

(71) Applicant: Gary Sprague, Visalia, CA (US)

(72) Inventor: Gary Sprague, Visalia, CA (US)

(73) Assignee: FRAMELESS HARDWARE COMPANY LLC, Southgate, CA (US)

( * ) Notice: Subject to any disclaimer, the term of this patent is extended or adjusted under 35 U.S.C. 154(b) by 231 days.

(21) Appl. No.: 17/370,136

(22) Filed: Jul. 8, 2021

(65) Prior Publication Data

US 2023/0012146 A1 Jan. 12, 2023

(51) Int. Cl.

| | |
|---|---|
| ***E05D 15/00*** | (2006.01) |
| ***E05D 15/06*** | (2006.01) |
| ***E06B 3/46*** | (2006.01) |
| *E06B 3/02* | (2006.01) |

(52) U.S. Cl.

CPC ..... *E05D 15/0647* (2013.01); *E06B 3/4681* (2013.01); *E05Y 2201/64* (2013.01);
(Continued)

(58) Field of Classification Search

CPC ..... E05D 15/00; E05D 15/1005; E05D 15/28; E05D 15/0608; E05D 15/0626; E05D 15/264; E05D 15/06; E05D 15/063; E05D 15/0643; E05D 15/0647; E05D 15/165; E05D 15/0621; E05D 15/0653; E05D 15/26; E05D 15/262; E05D 15/0652; E05D 15/0634; E05D 15/0639; E05D 5/0246; E05Y 2201/64; E05Y 2201/688; E05Y 2201/708; E05Y 2201/612; E05Y 2201/614; E05Y 2900/531; E05Y 2900/532; E05Y 2900/131;
(Continued)

(56) References Cited

U.S. PATENT DOCUMENTS

2009/0019665 A1* 1/2009 Kelley ..... E05D 15/066 16/105
2014/0013543 A1* 1/2014 Haab ..... E05D 15/0652 16/96 R
(Continued)

FOREIGN PATENT DOCUMENTS

CN 203515111 U * 4/2014
CN 204024290 U * 12/2014
(Continued)

*Primary Examiner* — Chuck Y Mah
(74) *Attorney, Agent, or Firm* — Cohen IP Law Group, PC; Michael N. Cohen

(57) ABSTRACT

A sliding panel system is disclosed. The system includes a fitting assembly designed to fixedly secure a first panel to an elongate rail member, and a carrier assembly designed to moveably secure a second panel to the elongate rail member. The system facilitates the lateral movement of the second panel with respect to the first panel. The carrier assembly includes at least one carrier unit including a housing with an inner volume, at least one roller unit configured in an upper portion of the inner volume, at least one guide member configured in the inner volume, and an opening extending across the front of the housing and adapted to receive a longitudinal portion of the rail member. The at least one roller unit and the at least one guide member are concealed within the housing when the housing is viewed from a perspective perpendicular to the front of the housing.

20 Claims, 10 Drawing Sheets

(52) U.S. Cl.
CPC ... *E05Y 2201/684* (2013.01); *E05Y 2201/688* (2013.01); *E05Y 2900/114* (2013.01); *E06B 3/02* (2013.01)

(58) Field of Classification Search
CPC ..... E05Y 2900/132; E05Y 2900/142; E05Y 2201/684; E05Y 2600/504; E05Y 2800/672; E05Y 2900/114; E06B 3/50; E06B 3/485; E06B 9/36; E06B 3/42; E06B 3/46; E06B 3/4609; E06B 3/4636; E06B 3/02; B60J 5/06; B60J 5/062; B60J 5/047; B60J 5/12; B60J 5/04; Y10T 16/364; Y10T 16/3813; Y10T 16/3837; Y10T 16/384; Y10T 16/3825; A47H 2023/025; A47H 1/04; A47H 15/00; A47H 15/02; A47H 15/04; B06B 3/4681
See application file for complete search history.

(56) References Cited

U.S. PATENT DOCUMENTS

| | | | | |
|---|---|---|---|---|
| 2014/0143980 | A1* | 5/2014 | Chang | E05D 15/0634 16/91 |
| 2018/0320427 | A1* | 11/2018 | Lam | E05D 15/0621 |
| 2020/0208451 | A1* | 7/2020 | Tarrega Klein | E05D 15/06 |
| 2021/0017800 | A1* | 1/2021 | Terno | E05D 15/063 |
| 2021/0062562 | A1* | 3/2021 | Kao | E06B 3/4681 |
| 2022/0307308 | A1* | 9/2022 | McDonald | E05F 5/003 |

FOREIGN PATENT DOCUMENTS

| | | | | |
|---|---|---|---|---|
| CN | 209429819 U | * | 9/2019 | |
| ES | 2818576 T3 | * | 4/2021 | A47K 3/34 |

* cited by examiner

FIG. 3A
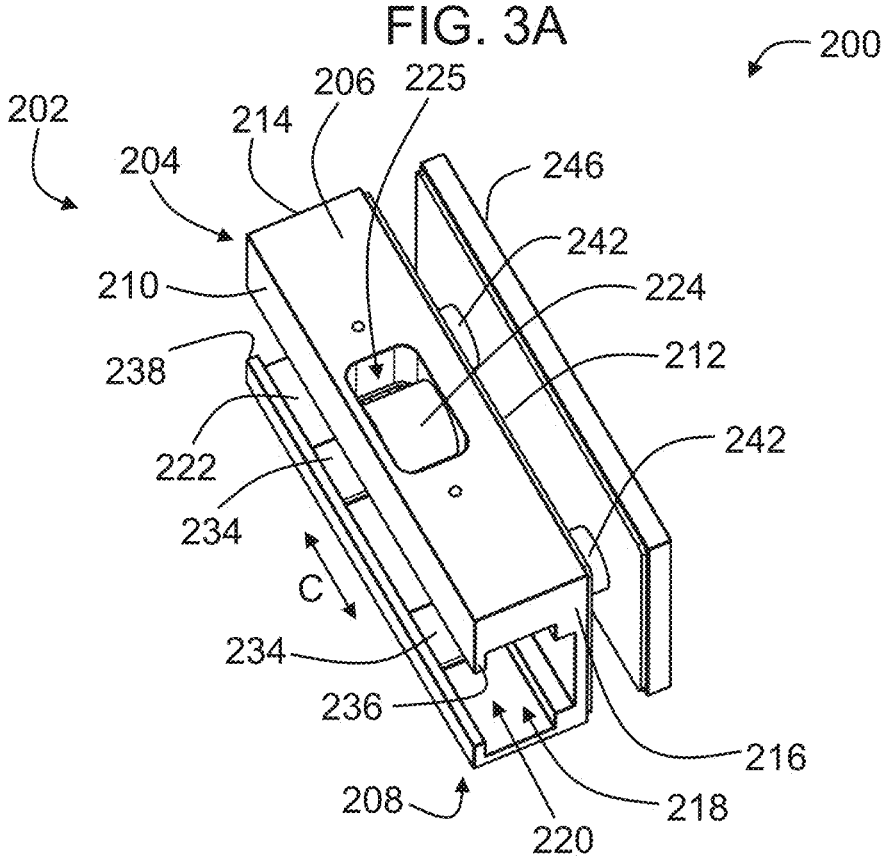
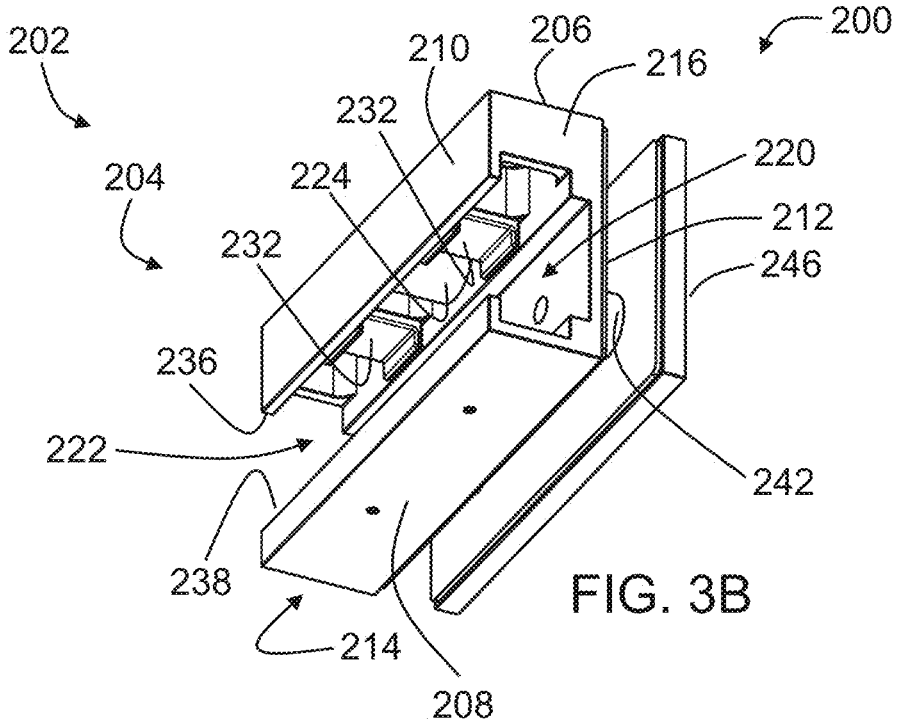
FIG. 3B

FIG. 5A
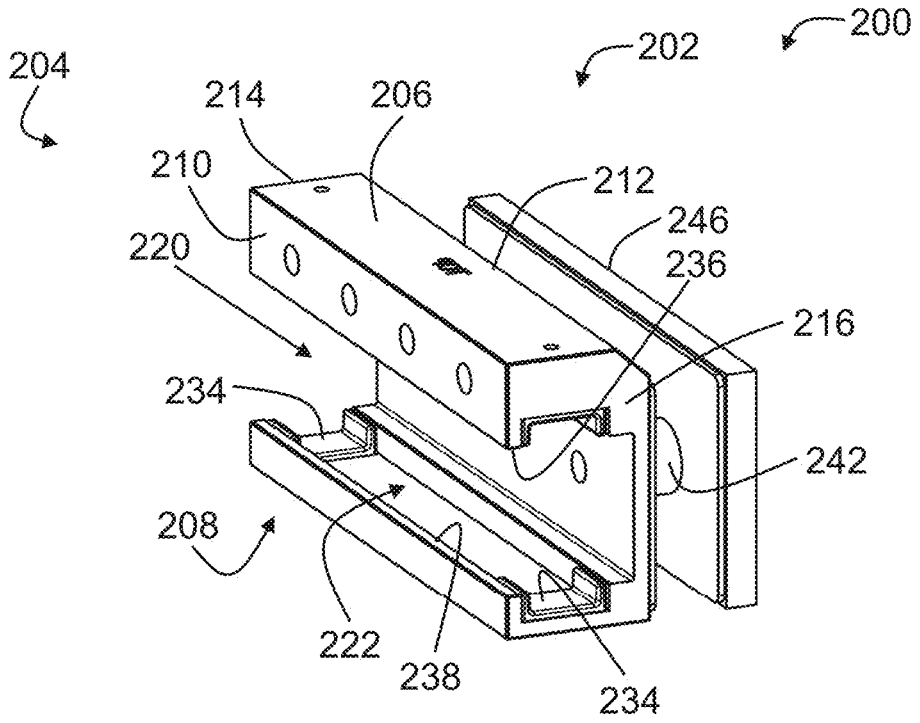
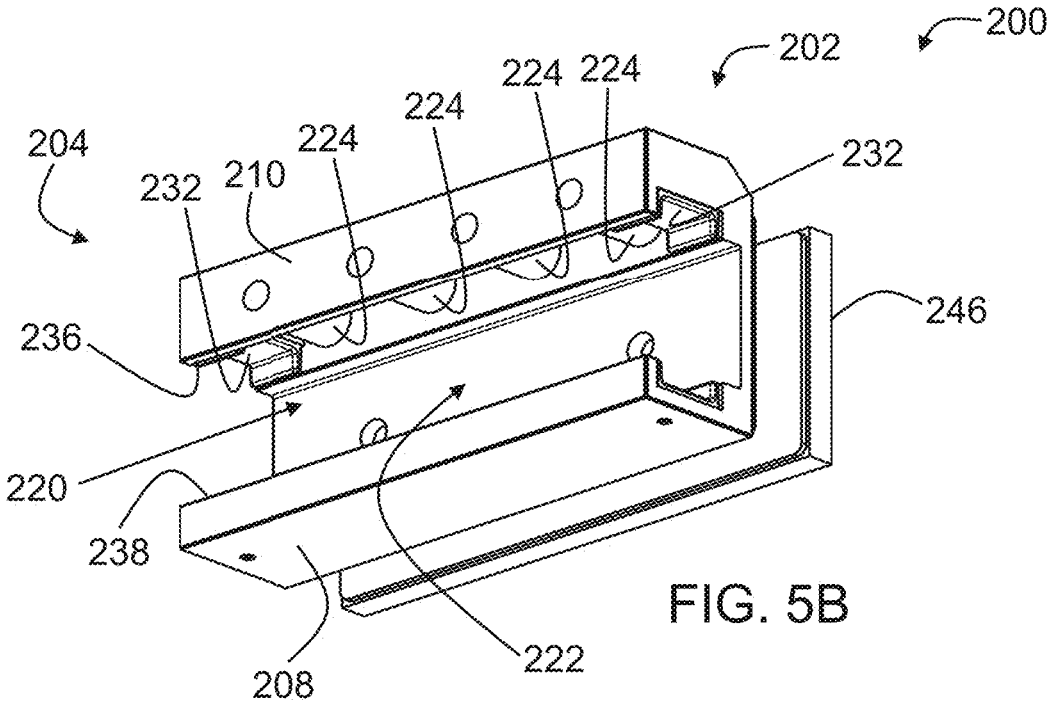
FIG. 5B

FIG. 7A
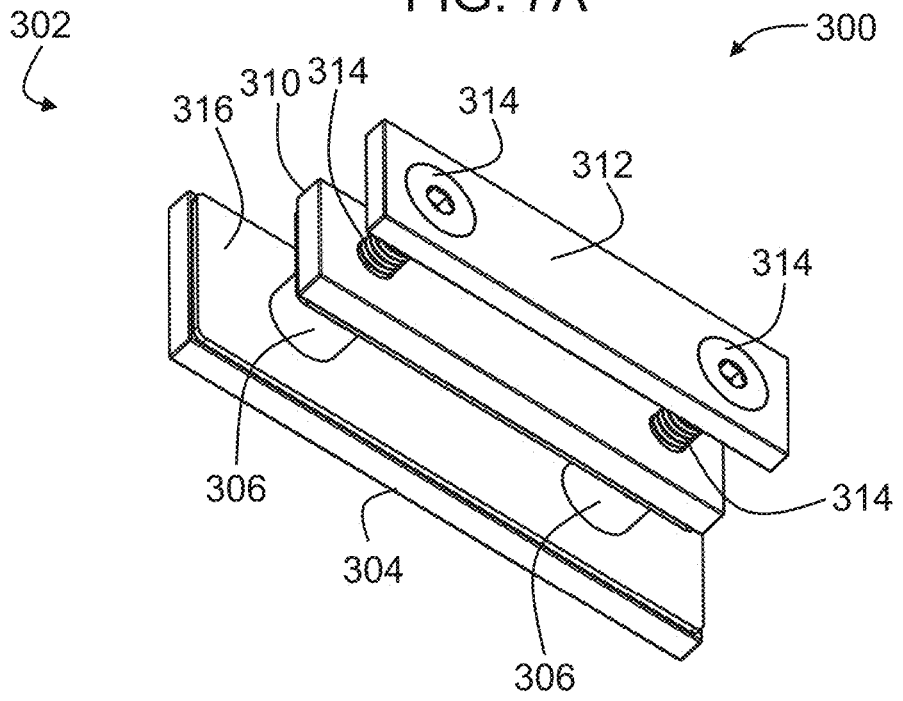
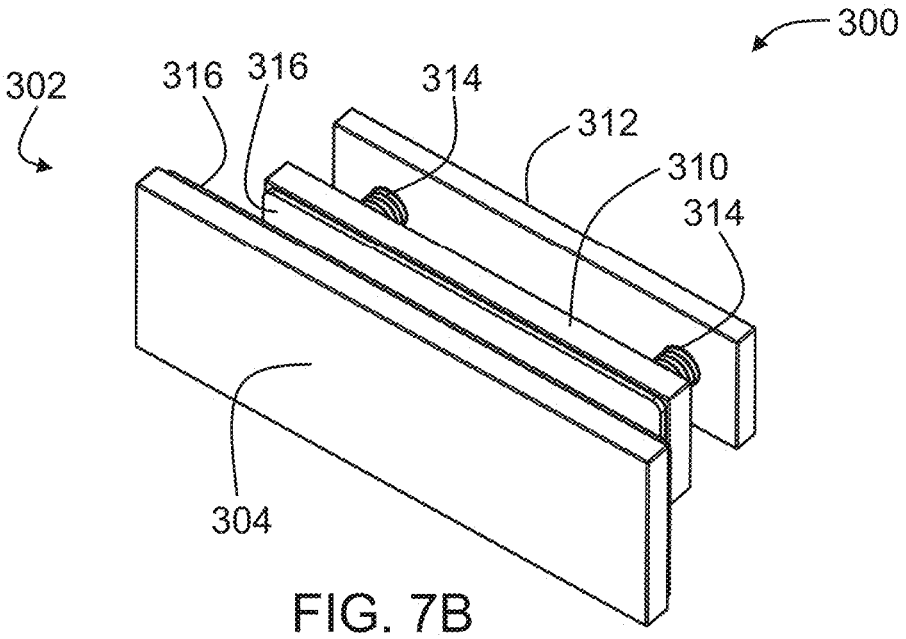
FIG. 7B

SLIDING PANEL SYSTEM AND METHOD

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

This invention relates to doors, including sliding door systems and methods.

BACKGROUND

Sliding glass shower doors are popular throughout the world, in both residential shower settings and in hospitality applications. However, because most of the glass doors are frameless, the doors typically include large and bulky rail and carrier assemblies. While these assemblies may adequately support the frameless glass panels, they unfortunately detract from the desired sleek frameless appearance.

Accordingly, there is a need for a reduced-size rail and carrier system that not only supports frameless sliding glass shower doors, but that also are sleek and streamlined in appearance. There also is a need for a rail and carrier system that conceals the elements of the carrier unit within a compact housing.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIGS. 3A-3B show aspects of a carrier assembly according to exemplary embodiments hereof;

FIGS. 5A-5B show aspects of a carrier assembly according to exemplary embodiments hereof;

FIGS. 7A-7B show aspects of a fitting assembly according to exemplary embodiments hereof;

DETAILED DESCRIPTION OF EXEMPLARY EMBODIMENTS

In general, the system according to exemplary embodiments hereof provides a sliding panel system and its method of use. The sliding panel system includes a rail member, one or more carrier units, and one or more fitting units. The fitting units are adapted to fixedly secure a first panel to the rail member and the carrier units are adapted to moveably connect a second panel onto the rail member. In this way, the second panel may move laterally along the rail member with respect to the first panel. Each carrier unit includes a housing within which the roller units and guide structures of the carrier unit are housed and concealed. In this way, the carrier units are compact.

Referring now to FIGS. 1-10, the system 10 according to exemplary embodiments hereof will be described in further detail.

Figure 1:
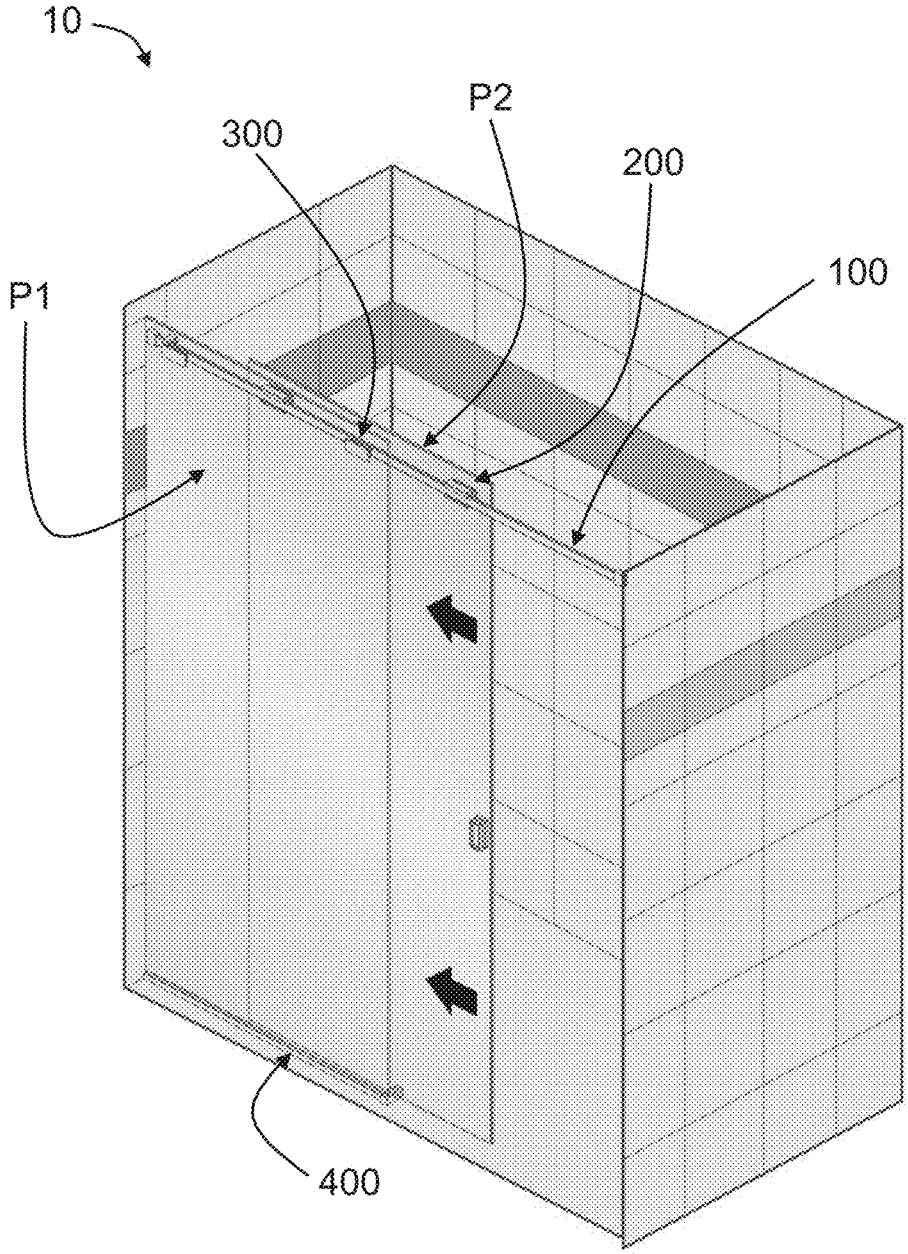
FIG. 1 shows aspects of a sliding panel system according to exemplary embodiments hereof.

In one exemplary embodiment hereof as shown in FIG. 1, the sliding panel system 10 includes a rail assembly 100, a panel carrier assembly 200, a fitting assembly 300, and a support assembly 400. The system 10 may include other elements and components as necessary to fulfill its functionalities.

In general, the system 10 is adapted to secure and support one or more panels P (e.g., glass door panels) and to facilitate the sliding of the panel(s) P laterally with respect to one another. In some embodiments, the rail assembly 100 provides an elongate structure (e.g., a rail or track) to which a first panel P1 may be fixedly attached and upon which a second panel P2 may travel. The fitting assembly 300 provides structures for fixedly securing the first panel P1 to the rail assembly 100, and the carrier assembly 200 provides structures that enable the second panel P2 to travel upon the rail assembly 100 laterally. The support assembly 400 provides additional structures to support and guide the panels P1, P2 when in use.

For the purposes of this specification, the system 10 will be described predominantly with respect to its implementation as a sliding shower door system. However, it is understood that the system 10 may be implemented for use with other types of panels and that the scope of the system 10 is not limited in any way by the types of panels that it may support.

Figure 2:
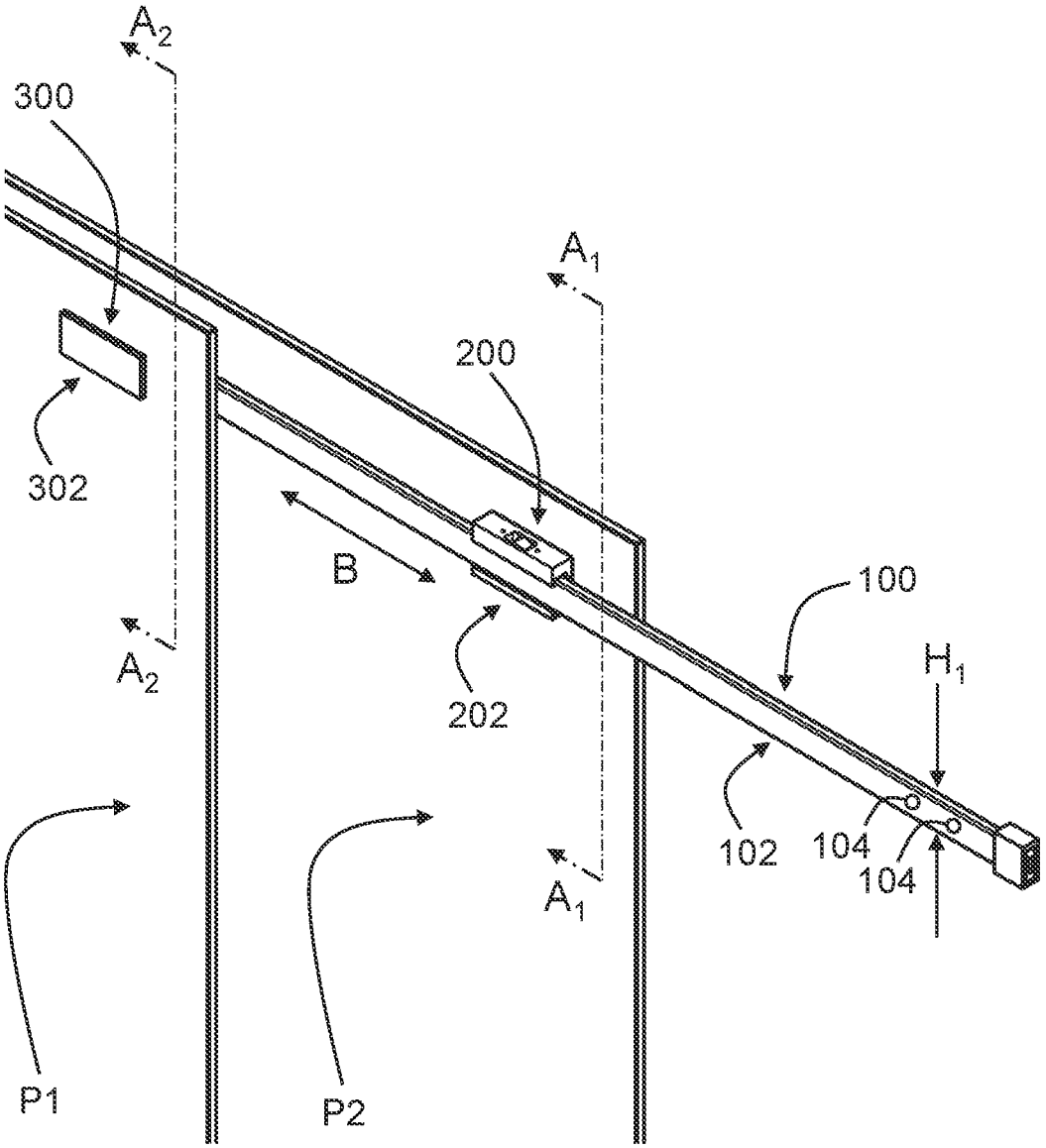
FIG. 2 shows a close-up portion of the sliding panel system of FIG. 1 according to exemplary embodiments hereof.

In one example as shown in FIGS. 1-2, the system 10 may be implemented with two glass panels P1, P2 as a sliding shower door system 10. As shown, a first glass panel P1 is fixedly attached to the rail assembly 100 (e.g., using the fitting assembly 300) and a second glass panel P2 is configured to slide horizontally along the rail assembly 100 with respect to the first glass panel P1 (e.g., using the carrier assembly 200). In this way, the system 10 facilitates the opening and closing of the shower door.

The various assemblies 100, 200, 300, and 400 will next be described in further detail.

Rail Assembly 100

In some embodiments as shown in FIG. 2, the rail assembly 100 provides the structure to support one or more panels P (e.g., P1 and P2) while facilitating the movement of the panel(s) P with respect to one another. The rail assembly 100 includes an elongate rail member 102 (also referred to as a track) that extends horizontally (along its longitudinal axis B) across an area within which the panel(s) P are to be held. In some embodiments, a first panel P1 may be stationary and may be fixedly attached to the rail member 102, while a second panel P2 may be moveably engaged with the rail member 102 so that it may move laterally with respect to the rail member 102 and to the first panel P1. As will be described in other sections, the first panel P1 may be fixedly attached to the rail member 102 using a fitting assembly 300 and the second panel P2 may be moveably engaged with the rail member 102 using a carrier assembly 200. In this way, the second panel P2 may form a sliding door that may slide open and closed.

The elongate rail member 102 may be formed as a rod, pole, pipe, shaft, dowel, beam, or other suitable elongate forms. The rail member 102 is adapted to generally extend across a space, e.g., between two walls or other types of support structures. In the example shown, the elongate member 102 is adapted to extend between a left wall and a right wall, thereby providing a structure upon which a shower door may be arranged between the walls. Note that the walls may comprise any type of upright bearing structure including, without limitation, tiled walls, bare walls, glass walls (or panels), plastic walls (or panels), beams, other types of structures, and any combinations thereof. Also, while the walls are depicted as opposing one another and generally parallel, the walls may be oriented at offset angles with respect to one another depending on the installation. In some embodiments, one or both of the walls may not be required.

While the elongate member 102 is shown to include a generally rectangular cross-section, it is understood that the rail member 102 may include other cross-sectional shapes such as circular, oval, triangular, octagonal, other suitable cross-sectional shapes, and any combinations thereof.

In some embodiments, the elongate member 102 includes one or more through-holes 104 adapted to receive an attachment member configured with one or more fitting assemblies 300. As will be described in other sections, by attaching the fitting assembly 300 to the elongate member 102, a panel P may be fixedly attached to the elongate member 102 and held secure within the system 10.

Panel Carrier Assembly 200

FIG. 2 shows a close-up portion of FIG. 1 showing the first and second panels P1, P2 configured with the system 10. The first panel is fixedly attached to a rail assembly 100 using a fitting assembly 300, and the second panel P2 is movably coupled to the rail assembly 100 using a carrier assembly 200.

In some embodiments, the carrier assembly 200 includes one or more carrier units 202, each adapted to receive and move laterally upon a portion of the elongate rail member 102.

In some embodiments as shown in FIGS. 3A-3B, the carrier unit 202 includes a housing 204 with a top 206, a bottom 208, a front 210, a back 212, a left side 214, and a right side 216, defining an inner volume 218. In some embodiments, the housing 204 is shaped as a rectangular prism (also referred to as a rectangular cuboid). However, it is understood that the housing 204 also may be shaped as other forms.

The housing 204 also includes a through channel 220 passing through its left 214 and its right 216 and through its inner volume 218 (defining its longitudinal axis C). The channel 220 is adapted to longitudinally receive a portion of the rail member 102. Accordingly, the channel 220 preferably includes a height that is slightly greater than the height of the rail member 102 so that the rail member 102 may fit and be free to move within the channel 220.

In some embodiments, the housing 204 also includes an opening 222 in its front 210 extending from its left side 214 to its right side 216 thereby providing access to the inner volume 218 and to the channel 220 therethrough. In some embodiments, a portion of the rail member 102 may be passed through the front opening 222 and into the channel 220 wherein it may be supported. In other embodiments, the carrier unit(s) 202 are preloaded onto the rail member 102 prior to mounting of the rail member 102 to the wall structures. Either way, the carrier unit 202 may be engaged with the rail member 102 for use (as shown in FIG. 2).

In general, the carrier unit 202 includes one or more roller units 224 configured in the upper portion of the channel 220. With a portion of a rail member 102 positioned longitudinally within the channel 220, the one or more rollers 224 may rest upon an upper surface of the rail member 102. In this way, the roller(s) 224 may roll upon the rail member 102 allowing the carrier unit 202 to move laterally.

In some embodiments as shown in FIGS. 3A-3B, the carrier unit 202 includes a single roller 224. As shown in the exploded view of the carrier unit 202 in FIG. 4, the roller 224 may comprise a bearing shaft 226 (e.g., an axle), a bearing 228 (e.g., a needle bearing), a roller tire 230, and front and rear thrust washers 233. A first end of the bearing shaft 226 is held within a first opening in the back 212 of the housing 204 and a second end of the bearing shaft 226 is held within a second opening in the front 210 of the housing 204. When held by the first and second openings, it is preferable that the bearing shaft 226 extend transverse and generally perpendicularly across the upper portion of the channel 220. In this configuration, the bearing 228 may be concentrically configured about the shaft 226 in the open area of the housing's inner volume 218 between the back 212 and front 210. Accordingly, the bearings 228 are completely internal within the housing 202. The roller tire 230 may be concentrically configured about the bearing 228, and, facilitated by the bearing 228, may spin freely about the shaft 226 in the upper area of the channel 220. In this way, the roller tire 230 and the entire roller unit 224 are completely internal within the housing 202.

In addition, the roller tire 230 and the entire roller unit 224 are preferably concealed within the inner volume 218 of the housing 204. For example, when looking at the carrier unit 202 from a viewing perspective perpendicular to its front 210 (as depicted by arrow D in FIG. 6), it is preferable that the entire roller unit 224 is concealed within the inner volume 218 of the housing 204 and that no portion of the roller unit 224 is visible.

With a rail member 102 received within the channel 220, the roller tire 230 may rest on and roll upon the upper surface of the rail member 102 as the carrier unit 202 moves laterally.

In some embodiments, the roller tire 230 includes a first side and a second side opposite the first side defining its axis of rotation, and an outer circumferential surface that is smooth (preferably entirely smooth) from the first end to the second end as depicted in FIG. 5. Accordingly, in some embodiments, the roller tire 230 may not include integrated derailment guides (e.g., no circumferential groove or channel within its outer circumferential surface) adapted to straddle or otherwise laterally hold an upper portion of a rail member 102 to the tire 230. As will be described in other sections, the carrier unit 202 may instead include separate and distinct derailment guides and mechanisms.

In some embodiments as shown in FIG. 3A, the top 206 of the housing 204 includes a cutout 225 in the area directly above the roller unit 224. The purpose of the cutout 225 is to allow an upper portion of the roller unit 224 (e.g., the upper portion of the roller tire 230) to extend into the cutout 325 and to spin freely therein. In this way, because the cutout 225 accommodates a portion of the height of the roller unit 224, the height of the housing's inner volume 218 and therefore the overall height H1 of the housing 204 itself (see FIG. 6) may be reduced by an amount generally equal to the height of the portion of roller unit 224 that the cutout 225 receives. It may be preferable that the top of the roller tire 230 be generally flush with the top 206 of the housing 204 when in this configuration. In this case, the overall height H1 of the housing 204 may be reduced by an amount generally equal to the thickness of the housing's top wall. In this configuration, it is understood that the entire roller unit 224 is still considered to be contained completely within the housing 204. In an alternative embodiment, the cutout 225 may be removed and the height H1 of the housing 204 may be extended to increase the height of the housing's inner volume 218 to accommodate the entire height of the roller unit 224 within.

In some embodiments, the carrier unit 202 includes one or more upper carrier guides 232 positioned in the upper portion of the channel 220 and adapted to provide upper and/or lateral support to the carrier unit 202 and the rail member 102 as the carrier 202 engages the rail 102. As shown in FIG. 3B, in some embodiments the carrier unit 202 includes two upper carrier guides 232, with a first upper carrier guide 232 positioned to the left of the roller 224 and a second upper carrier guide 232 positioned to the right of the roller 224. Other numbers of upper carrier guides 232 located in other positions also may be used. Each upper carrier guide 232 includes a downward-facing surface adapted to tangentially engage with an upper surface of a rail member 102 positioned within the channel 220. The downward facing surface may be vertically aligned and generally even with the bottom of the roller tire 230 or slightly above.

In some embodiments, the upper carrier guides 232 include a downward-facing U-shaped member aligned within the channel 220. The downward-facing inner surface of each U-shaped upper carrier guide 232 may tangentially engage with the upper surface of the rail member 102 while the side portions of the U-shaped carrier guide 232 may straddle and provide lateral support to the rail 102. In this way, the rail member 102 may be generally held within the upper carrier guides 232 as the carrier unit 202 moves along the rail 102. During use, this may align the rail member 102 with the roller unit 224 and prevent derailment of the carrier unit 202 from the rail 102.

In some embodiments as shown in FIG. 3A, the carrier unit 202 includes one or more lower carrier guides 234 positioned in the lower portion of the channel 220 and adapted to provide lower support to the carrier unit 202 and to the rail 102 as the carrier 202 engages the rail 102. In some embodiments the carrier unit 202 includes two lower carrier guides 234, with a first lower carrier guide 234 generally positioned below and opposing a first upper carrier guide 232 and a second lower carrier guide 234 generally positioned below and opposing a second upper carrier guide 232. Each lower carrier guide 234 includes an upward-facing surface adapted to tangentially engage with a lower surface of a rail member 102 positioned within the channel 220. In some embodiments, it may be preferable that the upward-facing inner surface of each lower carrier guide 234 be positioned slightly below the lower surface of the rail member 102 during use.

In some embodiments, the lower carrier guides 234 include an upward-facing U-shaped member aligned within the channel 220. The upward-facing inner surface of each U-shaped lower carrier guide 234 may tangentially engage with the lower surface of the rail member 102 while the side portions of the U-shaped carrier guide 234 may straddle and provide lateral support to the rail 102. In this way, the rail member 102 may be generally held within the lower carrier guides 234 as the carrier unit 202 moves along the rail 102. During use, this may prevent derailment of the carrier unit 202 from the rail 102. In some embodiments, it may be preferable that the upward-facing inner surface of each U-shaped lower carrier guide 234 be positioned slightly below the lower surface of the rail member 102 during use.

Given the above, in some embodiments, the rail member 102 may be loosely held between the two pairs of upper and lower carrier guides 232, 234 as the carrier unit 202 rolls laterally upon the rail member 102. It is preferable that the upper and/or lower carrier guides 232, 234 not obstruct the carrier unit 202 in any way as it moves upon the rail 102.

In some embodiments as shown in FIGS. 3A-3B, the carrier unit 202 includes an upper derailment guide 236 configured across an upper portion of the front opening 222, and a lower derailment guide 238 configured across a lower portion of the front opening 222. In some embodiments, the upper derailment guide 236 includes a downward facing lip extending across the upper portion of the front opening 222 from the housing's left 214 to its right 216 (or at least a portion thereof). In some embodiments, the lower derailment guide 238 includes an upward facing lip extending across the lower portion of the front opening 222 from the housing's left 214 to its right 216 (or at least a portion thereof). With a rail member 102 positioned longitudinally within the channel 220 and the roller 224 within the housing 202 resting on the upper surface of the rail 102, the upper derailment guide's downward facing lip and the lower derailment guide's upward facing lip may each help to prevent the rail member 102 from becoming derailed or otherwise dislodged from the carrier unit 202. That is, the upper and lower derailment guides 236, 238 may tend to keep the rail member 102 within the channel 220 and may prevent any portion of the rail member 102 from passing outward through the housing's front opening 222 during use.

In some embodiments, the upper derailment guide 236 (and the upper portion of the housing's front 210) conceals the roller unit 224 and/or the upper carrier guides 232 within the housing 202, and the lower derailment guide 238 (and the lower portion of the housing's front 210) conceals the lower carrier guides 234 within the housing 202. For example, when looking at the carrier unit 202 from a viewing perspective perpendicular to its front 210 (as depicted by arrow D in FIG. 6), it is preferable that the entire roller unit 224 and the upper carrier guides 232 within the inner volume 218 of the housing 204 are concealed behind the upper derailment guide 236 (and the upper portion of the housing's front 210) and that no portion of the roller unit 224 or of the upper carrier guides 232 is visible. In addition, when looking at the carrier unit 202 from a perspective perpendicular to its front 210 (as depicted by arrow D in FIG. 6), it is preferable that the lower carrier guides 234 within the inner volume 218 of the housing 204 are concealed behind the lower derailment guide 238 (and the lower portion of the housing's front 210) and that no portion of the lower carrier guides 232 is visible.

Figure 6:
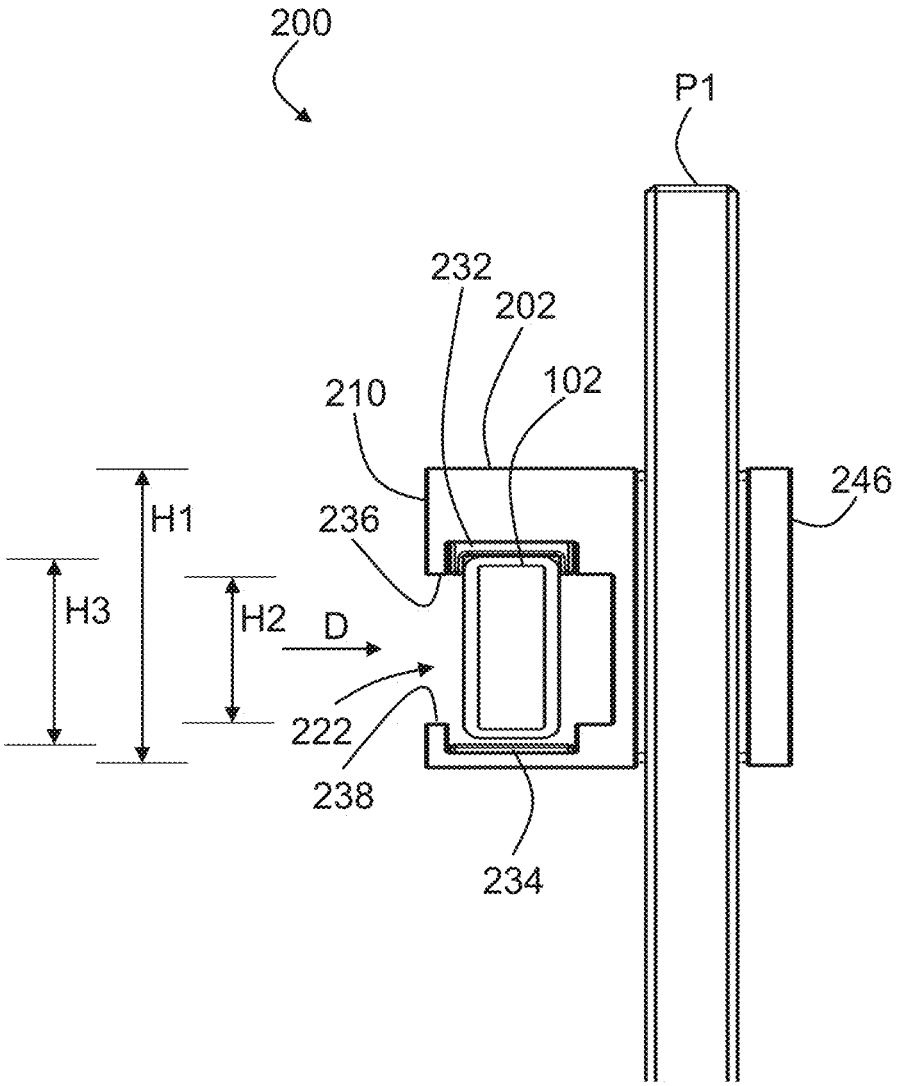
FIG. 6 shows aspects of carrier assembly and a rail member configured with a panel according to exemplary embodiments hereof.

In some embodiments, the height H2 of the cutout 222 when configured with the upper and lower derailment guides 236, 238 is less than the height H3 of the rail member 102 (see FIG. 6). Accordingly, with the rail member 102 configured longitudinally within the channel 220 and with the roller tire 230 resting on the upper surface of the rail 102, viewing the carrier unit 202 from a perspective perpendicular to its front 210 (as depicted by arrow D in FIG. 6), the upper derailment guide 236 (and the upper portion of the housing's front 210) conceals an upper portion of the rail member 102 and its interface with the roller tire 230. In addition, from this same viewing perspective, the lower derailment guide 238 (and the lower portion of the housing's front 210) preferably conceals a lower portion of the rail member 102.

In other embodiments, the carrier unit 202 includes multiple roller units 224. For example, as shown in FIGS. 5A-5B, the carrier unit 202 includes a total of four roller units 224 configured sequentially between the housing's left 214 and right 216. It may be preferable that the multiple roller units 224 be evenly spaced but this may not be required. It also may be preferable that the multiple roller units 224 be generally identical with one another but this too may not be required. It is understood that any number of roller units 224 may be used.

In some embodiments, a roller unit 202 with multiple roller units 224 may include a first upper carrier guide 232 to the far left of the sequential multiple roller units 224 and a second upper carrier guide 232 to the far right of the sequential multiple roller units 224. It also is contemplated that upper carrier guides 232 may be arranged between any of the multiple roller units 224 as desired.

It is understood that any and/or all of the aspects and elements described in other sections with respect to a carrier unit 202 with a single roller unit 224 (FIGS. 3A-3B and 4) also may apply to a carrier unit 202 with multiple roller units 224 (FIGS. 5A-5B).

Figure 4:
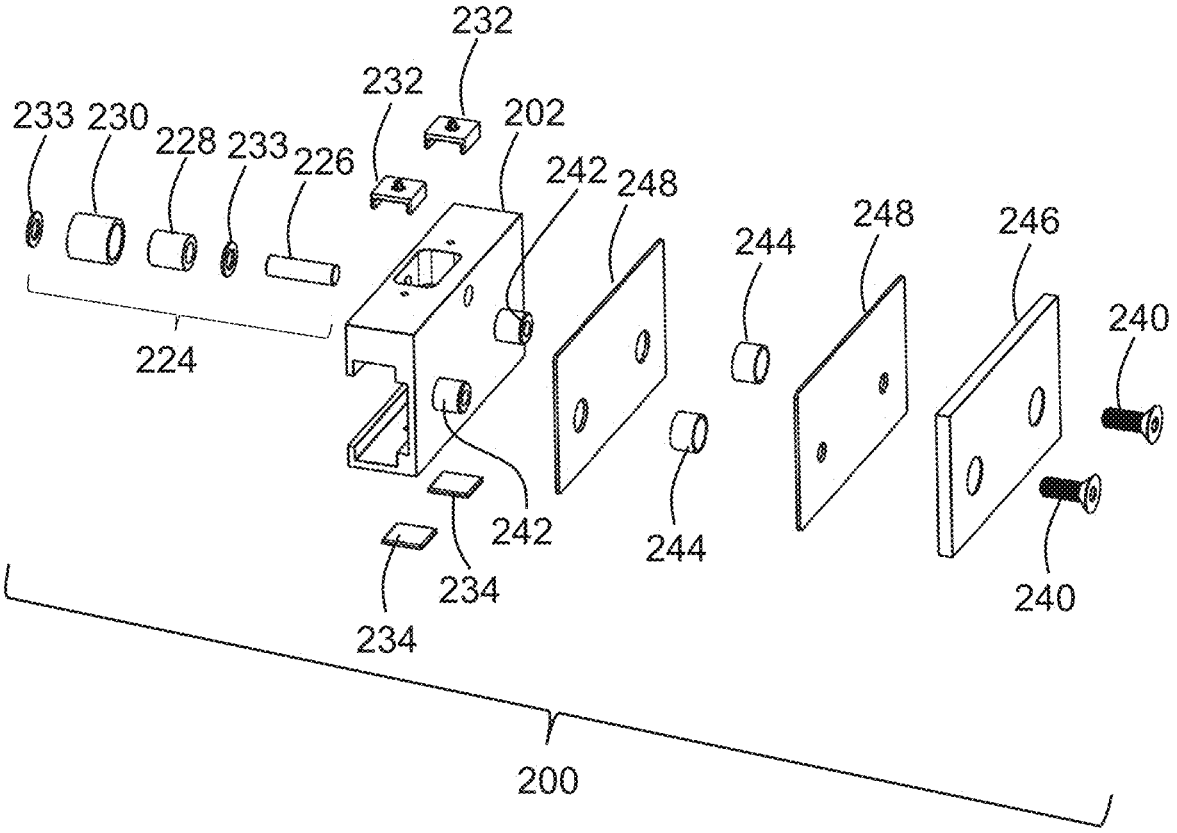
FIG. 4 shows an exploded view of a carrier assembly according to exemplary embodiments hereof.

In some embodiments, each carrier unit 202 is secured to a panel P (e.g., panel P2) using attachment members 240 that pass through the panel P. As shown in FIG. 4, the housing 204 includes one or more (preferably two) attachment posts 242 extending perpendicularly outward from its back 212, each with a center attachment hole in its distal end. Corresponding holes are made in the panel P, with each hole sized to fit one mounting plate grommet 244. Each mounting plate grommet 244 includes a center through-hole sized to receive an attachment post 242. Accordingly, each hole within the panel P may receive a mounting plate grommet 244 which in turn may receive an attachment post 242.

During integration, the holes are made through the panel P and a grommet 244 is placed within each hole. The back 212 of the carrier unit 202 is then pressed against the inside surface of the panel P so that each attachment post 242 passes through its corresponding grommet 244. In this configuration, it is preferable that the distal end of each attachment post 242 be generally flush with the opposite side of the panel P. A mounting plate 246 with openings corresponding to the attachment holes at the ends of each attachment post 242 is pressed against the opposite surface of the panel P. The attachment members 240 (e.g., flat head socket cap screws) are then passed through the openings in the mounting plate 246 and screwed into the attachment holes at the distal end of each attachment post 242 and tightened. In this way, the panel P is sandwiched between the mounting plate 246 and the back side 212 of the carrier unit 202. In some embodiments, a mounting plate gaskets 248 may be positioned on either side of the panel P, e.g., between the panel P and the back 212 of the carrier unit 202 and/or between the panel P and the mounting plate 246. The gaskets 248 may cushion the elements with the panel P and provide waterproofing to the junctions.

FIG. 6 shows the result of the above described configuration of the carrier unit 202 and associated rail member 102 taken from the perspective of the cutlines $A_1$-$A_1$ of FIG. 2.

Fitting Assembly 300

In some embodiments, a fitting assembly 300 is adapted to fixedly secure a panel P (e.g., the first panel P1) to an elongate member 102.

Figure 8:
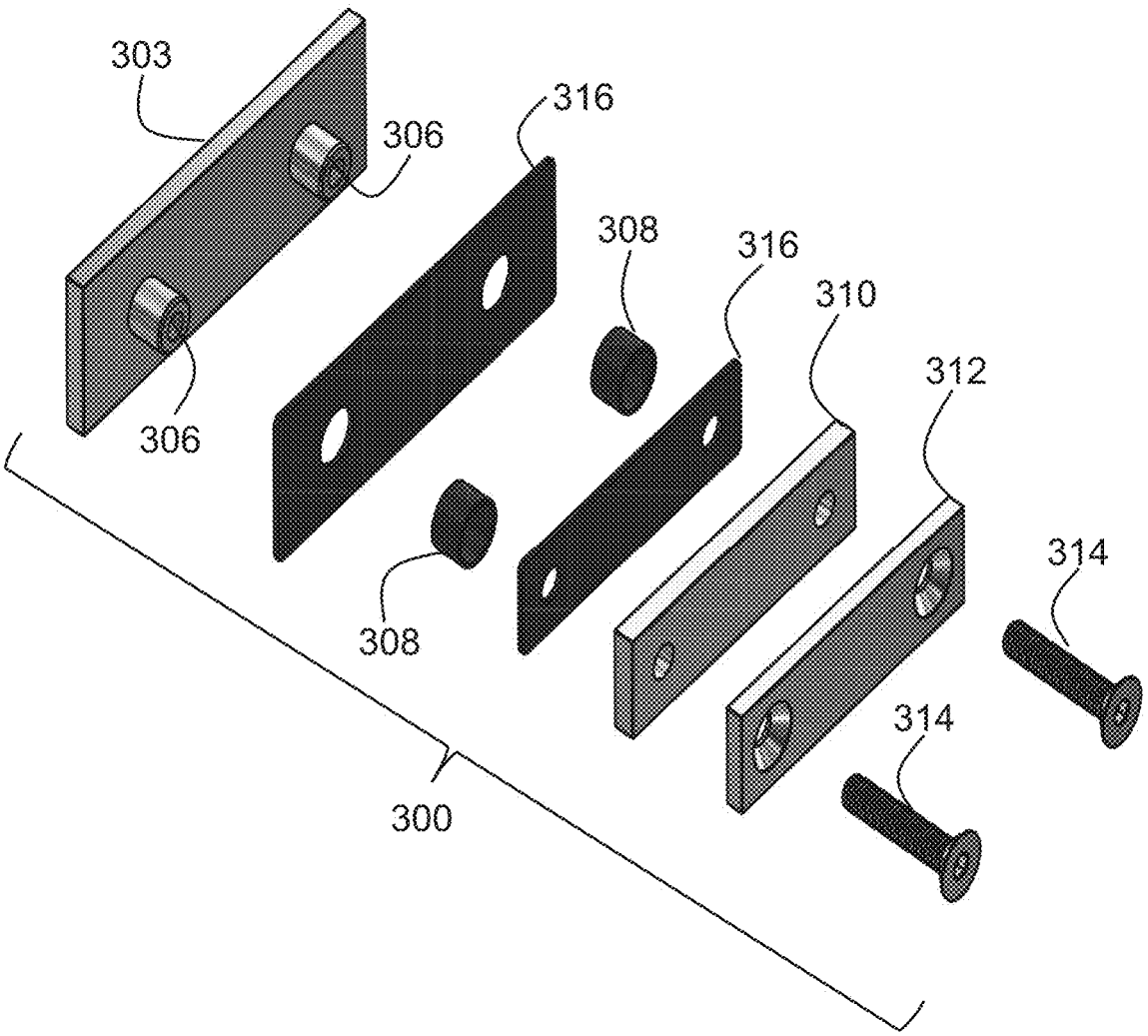
FIG. 8 shows an exploded view of a fitting assembly according to exemplary embodiments hereof.

In some embodiments as shown in FIGS. 7A-7B and 8, the fitting assembly 300 includes a fixed panel fitting unit 302. FIGS. 7A-7B show assembled fitting assemblies 300 and FIG. 8 shows an exploded view of a fitting assembly 300. Each fitting unit 302 includes a first mounting plate 304 (also referred to as an outside mounting plate) including one or more attachment posts 306 each with an attachment hole on its distal end, mounting plate grommet(s) 308, a second mounting plate 310 (also referred to as an intermediate mounting plate), a third mounting plate 312 (also referred to as an inside mounting plate), one or more attachment mechanisms 314 (e.g., flat head socket cap screws), and one or more gaskets 316.

During integration, holes are made through the panel P and a grommet 308 is placed within each hole. The back of the first mounting plate 304 is then pressed against the outside surface of the panel P so that each attachment post 306 passes through its corresponding grommet 308. In this configuration, it is preferable that the distal end of each attachment post 306 be generally flush with the opposite side of the panel P. A second mounting plate 310 with openings corresponding to the attachment holes at the ends of each attachment post 306 is next pressed against the opposite surface of the panel P.

Next, a rail member 102 is aligned with the second mounting plate 310 with the rail member's through-holes 104 aligned with the second mounting plate's openings. The third mounting plate 312 is then positioned on the opposite side of the rail member 102 with openings aligning with the rail member's through-holes 104 on the opposite side. An attachment member 314 (e.g., a flat head socket cap screw) is then passed through the openings of the third mounting plate 312, through the side openings 104 of the rail member 102, through the grommets 308 within the holes in the panel P, and into the distal end attachment holes of the first mounting plate's attachment posts 306. The attachment members 314 (screws) are then screwed into the distal end attachment openings of the attachment posts 306 and tightened. In this configuration, the panel P is sandwiched between the first and second mounting plates 304, 310, and the rail member 102 is sandwiched between the second and third mounting plates 310, 31

In some embodiments, mounting plate gaskets 316 may be positioned on either side of the panel P, e.g., between the panel P and the back of the first mounting plate 304 and/or between the panel P and the second mounting plate 310. The gaskets 316 may cushion the elements with the panel P and provide waterproofing to the junctions.

Figure 9:
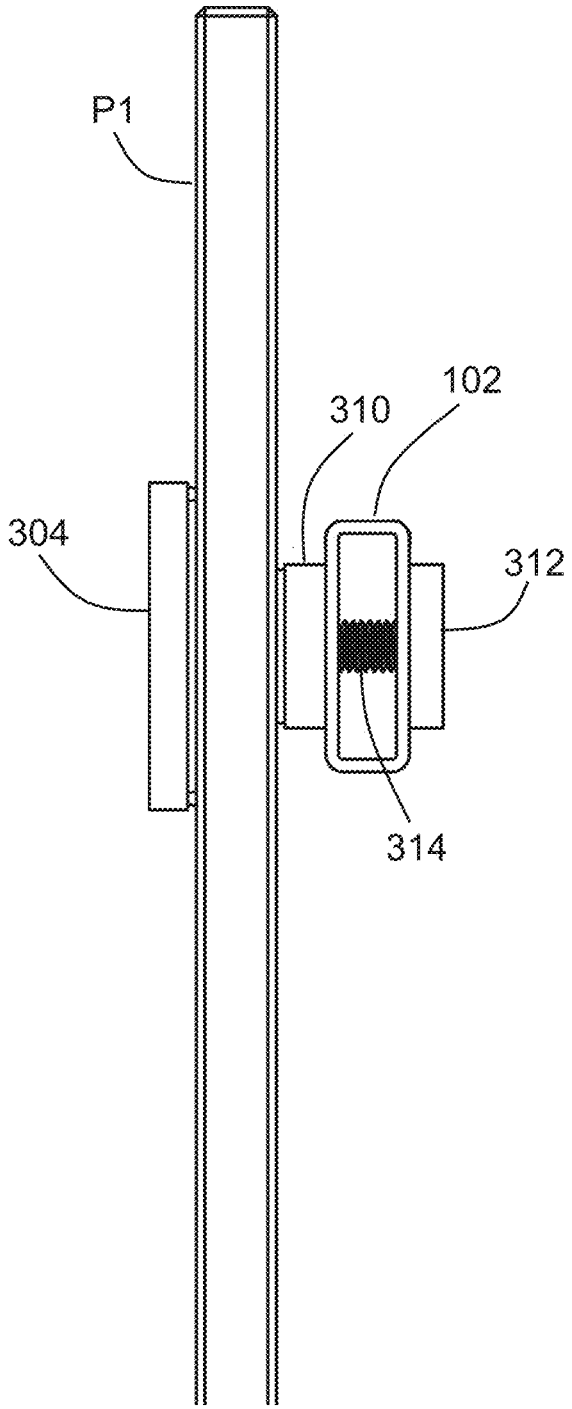
FIG. 9 shows aspects of a fitting assembly and a rail member configured with a panel according to exemplary embodiments hereof.

FIG. 9 shows the result of the above described configuration of the fitting unit 302 and associated rail member 102 taken from the perspective of the cutlines A2-A2 of FIG. 2.

Figure 10:
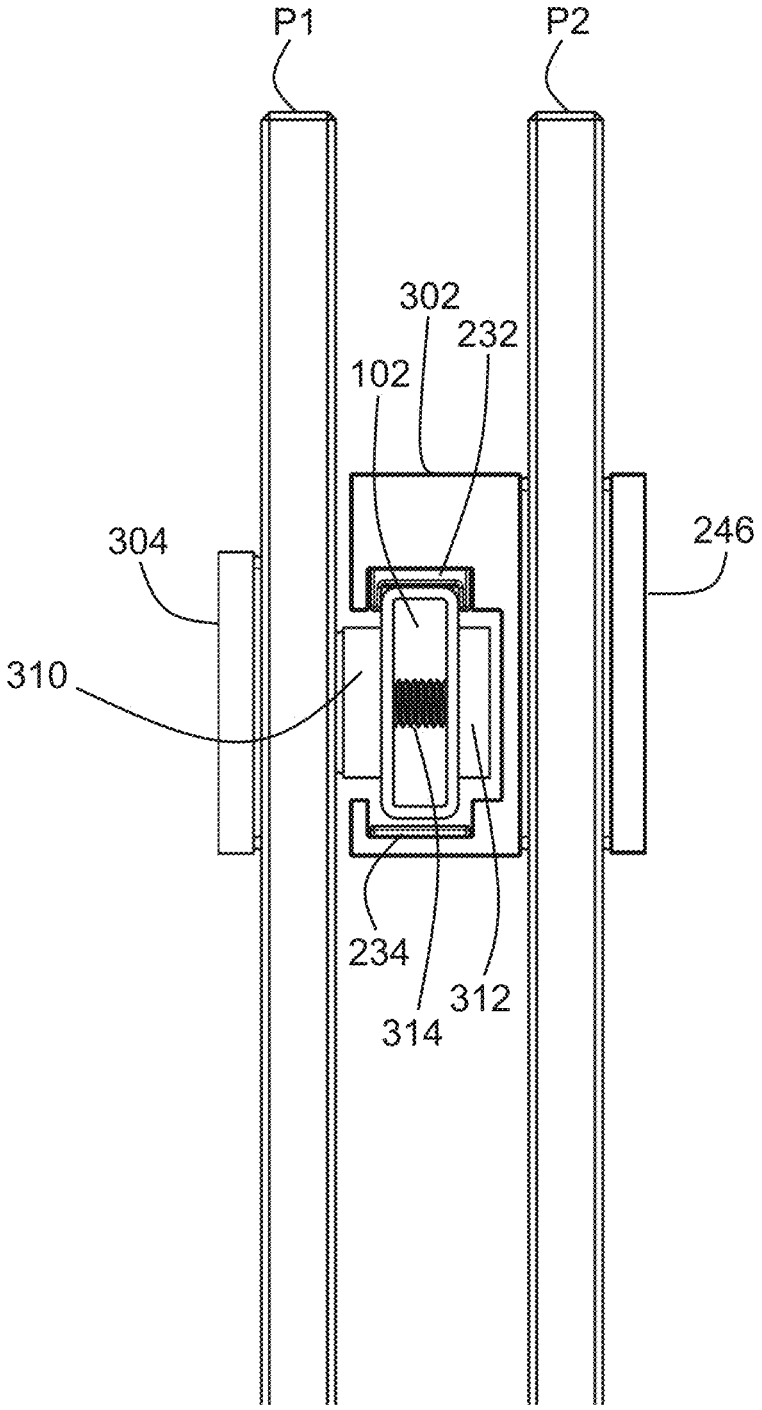
FIG. 10 shows aspects of a fitting assembly, a carrier assembly, and a rail member configured with a first and second panel according to exemplary embodiments hereof.

FIG. 10 shows the result of the above described configurations of both a carrier unit 202 and a fitting unit 302, and an associated rail member 102 taken from the perspective of the cutlines $A_1$-$A_1$ of FIG. 2.

Support Assembly 400

In some embodiments as shown in FIG. 1, the system 10 includes a support assembly 400 comprising various components to support the various elements of the system 10. For example, the support assembly 400 may include wall mount fittings adapted to secure an end of the elongate rail member 102 to a wall or other structure, floor-mounted panel guides adapted to provide lateral support to the panels P during use, a pull handle attached to a slidable panel (e.g., the second panel P2) to grasp and slide the panel P2 open and closed, sliding panel stoppers attachable to the rail member 102 to provide a stop to the carrier unit(s) 202 as they travel along the rail 102, and other support elements as required.

Benefits of the System 10

The benefits of the system 10 are multifold and include, without limitation:

First, in some embodiments, the roller unit 224 does not include integrated derailment guides about its outer circumferential surface of the roller tire 230. Instead, the upper carrier guides 232 and the upper derailment guide 236 are separate and distinct from the roller unit 224. Accordingly, the outer circumferential surface of the roller tire 230 may be flat. This allows the height of the roller unit 224 to be reduced thereby reducing the overall height of each carrier unit 202. Further, this also allows for the use of a needle bearing 228 with a wide and low profile. In some embodiments, the needle bearing 228 includes a length (measured along the axis upon which it rotates) that is 0.5-3 times its diameter. In some embodiments, the roller tire 230 includes a length (measured along the axis upon which it rotates) that is 0.5-3 times its diameter.

Second, the carrier unit 202 does not include a lower roller unit 224 to support a lower portion of the rail member 102. Instead, the carrier unit 202 includes individual and distinct lower carrier guides 234 as well as an individual and distinct lower derailment guide 238. This eliminates the need for a lower roller unit thereby allowing for the further reduction of the overall height of each carrier unit 202.

Third, the roller unit(s) 224 are fully concealed within each carrier housing 204 and are out of sight. For example, in some embodiments, the roller unit(s) 224 are concealed by the upper derailment guide 236.

Fourth, the upper and lower carrier guides 232, 234 are fully concealed within each carrier housing 204 and are out of sight. For example, in some embodiments, the upper and lower carrier guides 232, 234 are concealed by the upper and lower derailment guides 236, 238, respectively.

It is understood that in any of the embodiments described herein or otherwise, the configuration of the various assemblies, panels, and other elements are reversible, and that the system 10 may be configured with a slidable first panel P1 and a stationary second panel P2.

In any of the embodiments, the components of the assemblies 100, 200, 300, 400 may comprise stainless steel, other types of metals, plastics, composite materials, other suitable materials, and any combinations thereof.

It is understood that the benefits shown above are meant for demonstration and that other benefits of the system 10 may also exist. Those of ordinary skill in the art will appreciate and understand, upon reading this description, that embodiments hereof may provide different and/or other advantages, and that not all embodiments or implementations need have all advantages.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. A sliding panel carrier assembly comprising:

a housing including a left side, a right side, a front side, a back side, a top side, and a bottom side defining an inner volume;

a channel passing through the left side, the inner volume, and the right side, and defining a first longitudinal axis;

an opening in the front side extending from outside the housing to the inner volume and from the left side to the right side;

at least one roller unit configured within an upper portion of the inner volume and adapted to rotate about an axis perpendicular to the first longitudinal axis; and at least one attachment mechanism configured with the back side of the housing and adapted to attach the housing to a first panel;

wherein the at least one roller unit is concealed within the housing from a viewing perspective perpendicular to the front of the housing.

2. The sliding panel carrier assembly of claim 1 further comprising:

at least one upper guide member configured in the upper portion of the inner volume and adjacent the roller unit.

3. The sliding panel carrier assembly of claim 2 wherein the at least one upper guide member includes a first upper guide member located adjacent to a first side of the at least one roller unit and a second upper guide member located adjacent to a second side of the least one roller unit opposite the first side.

4. The sliding panel carrier assembly of claim 2 wherein the at least one upper guide member is concealed within the housing from a viewing perspective perpendicular to the front of the housing.

5. The sliding panel carrier assembly of claim 2 wherein the at least one upper guide member includes a downward-facing U-shaped member.

6. The sliding panel carrier assembly of claim 1 further comprising an upper derailment guide configured with an upper portion of the opening and comprising a downward facing lip extending across at least a portion of the opening from the left to the right.

7. The sliding panel carrier assembly of claim 1 further comprising a lower derailment guide configured with a lower portion of the opening and comprising an upward facing lip extending across at least a portion of the opening from the left to the right.

8. The sliding panel carrier assembly of claim 1 wherein the channel is adapted to receive a longitudinal portion of a rail member.

9. The sliding panel carrier assembly of claim 1 further comprising:

an elongate rail member including a first end and a second end defining a second longitudinal axis, and with an upper surface;

wherein a portion of the elongate rail member is located within the channel with the second longitudinal axis aligned with the first longitudinal axis.

10. The sliding panel carrier assembly of claim 9 wherein the at least one roller unit rests on the upper surface of the rail member at a first interface.

11. The sliding panel carrier assembly of claim 10 wherein the first interface between the upper surface of the rail member and the roller unit is concealed within the housing from a viewing perspective perpendicular to the front of the housing.

12. The sliding panel carrier assembly of claim 9 wherein an upper portion of the elongate rail member is concealed within the housing from a viewing perspective perpendicular to the front of the housing.

13. The sliding panel carrier assembly of claim 9 wherein a lower portion of the elongate rail member is concealed within the housing from a viewing perspective perpendicular to the front of the housing.

14. The sliding panel carrier assembly of claim 9 wherein the opening includes a first height, and the rail member includes a second height, and the first height is less than the second height.

15. The sliding panel carrier assembly of claim 1 wherein the at least one roller unit includes an outer roller tire with a first side and a second side opposite the first side defining its axis of rotation, the outer roller tire including an outer circumferential surface that is entirely smooth.

16. The sliding panel carrier assembly of claim 1 further comprising a cutout in the top side of the housing in an area above the roller unit, the cutout adapted to receive a portion of the at least one roller unit.

17. The sliding panel carrier assembly of claim 1 wherein the at least one roller unit includes a single roller unit.

18. The sliding panel carrier assembly of claim 1 wherein the at least one roller unit includes a total of four roller units.

19. The sliding panel carrier assembly of claim 1 wherein the at least one attachment mechanism includes at least one post adapted to extend from the back side of the housing, through the first panel, and to a first side of a mounting plate.

20. The sliding panel carrier assembly of claim 1 wherein the housing is shaped as a rectangular prism.

* * * * *